US008634744B2

(12) United States Patent
Nishiyama et al.

(10) Patent No.: US 8,634,744 B2
(45) Date of Patent: Jan. 21, 2014

(54) IMAGE FORMING DEVICE AND TONER CARTRIDGE MOUNTED THEREIN

(75) Inventors: Hideshi Nishiyama, Nagoya (JP); Naoya Kamimura, Ichinomiya (JP); Nao Itabashi, Nagoya (JP); Ryuya Yamazaki, Nagoya (JP); Masashi Imai, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 330 days.

(21) Appl. No.: 13/071,350

(22) Filed: Mar. 24, 2011

(65) Prior Publication Data

US 2012/0003000 A1 Jan. 5, 2012

(30) Foreign Application Priority Data

Jun. 30, 2010 (JP) ..... 2010-149716

(51) Int. Cl.
*G03G 15/00* (2006.01)

(52) U.S. Cl.
USPC ..... 399/110; 399/258; 399/262

(58) Field of Classification Search
USPC ..... 399/110, 119, 258, 260, 262
See application file for complete search history.

(56) References Cited

U.S. PATENT DOCUMENTS

| | | | |
|---|---|---|---|
| 5,848,338 | A | 12/1998 | Okada |
| 7,010,250 | B1 | 3/2006 | Yahagi |
| 2005/0196184 | A1 | 9/2005 | Koyama et al. |

(Continued)

FOREIGN PATENT DOCUMENTS

| | | | |
|---|---|---|---|
| JP | H07-104571 | A | 4/1995 |
| JP | H10-207203 | A | 8/1998 |
| JP | 2001-222160 | A | 8/2001 |
| JP | 2001-272899 | A | 10/2001 |
| JP | 2005-250362 | A | 9/2005 |

(Continued)

OTHER PUBLICATIONS

Japan Patent Office, Office Action for Japanese Patent Application No. 2010-149716 (counterpart to above-captioned patent application), mailed Apr. 24, 2012.

*Primary Examiner* — Walter L Lindsay, Jr.
*Assistant Examiner* — Barnabas Fekete
(74) *Attorney, Agent, or Firm* — Baker Botts L.L.P.

(57) ABSTRACT

An image forming device includes: a main casing; a retaining member; a plurality of developing units; a plurality of toner cartridges; and an operation unit. The retaining member is configured to be movable in a first direction between an accommodated position and a pulled-out position. The retaining member includes a first side plate and a second side plate extending in the first direction and disposed in confrontation with and spaced apart from each other in a second direction orthogonal to the first direction. The developing units are retained in the retaining member. The toner cartridges have one-on-one correspondence to the developing units and are configured to be mountable in or detachable from the retaining member when the retaining member is located at the pulled-out position. Each toner cartridge includes a casing formed with a cartridge opening, and a cartridge shutter configured to be movable between an open position for opening the cartridge opening and a closed position for closing the cartridge opening. The operation unit is provided in the retaining member and configured to be pivotally movable in an imaginary plane parallel to the first direction and the second direction. The operation unit is interlocked with the cartridge shutter while the toner cartridge is mounted in the retaining member to move the cartridge shutter between the open position and the closed position in accordance with the pivotal movement of the operation unit.

20 Claims, 10 Drawing Sheets

(56) References Cited

U.S. PATENT DOCUMENTS

| | | | | |
|---|---|---|---|---|
| 2008/0075506 | A1* | 3/2008 | Sato | 399/262 |
| 2009/0169267 | A1 | 7/2009 | Sakuma | |
| 2009/0324261 | A1 | 12/2009 | Suzuki | |
| 2010/0080615 | A1 | 4/2010 | Kikuchi | |

FOREIGN PATENT DOCUMENTS

| | | | |
|---|---|---|---|
| JP | 2009-157204 | A | 7/2009 |
| JP | 2010-008950 | A | 1/2010 |
| JP | 2010-101990 | A | 5/2010 |
| JP | 2010-102304 | A | 5/2010 |

* cited by examiner

IMAGE FORMING DEVICE AND TONER CARTRIDGE MOUNTED THEREIN

CROSS REFERENCE TO RELATED APPLICATION

This application claims priority from Japanese Patent Application No. 2010-149716 filed Jun. 30, 2010. The entire content of the priority application is incorporated herein by reference.

TECHNICAL FIELD

The present invention relates to an image forming device such as a laser printer and a toner cartridge mounted in the image forming device.

BACKGROUND

Laid-Open Japanese Patent Application Publication No. 2010-101990 discloses a tandem type color printer. The color printer has a main casing, and, within the main casing, four photosensitive drums for colors of yellow, magenta, cyan, and black are arranged parallel to each other. Four developing cartridges are provided in the color printer so as to have a one-on-one correspondence to the four photosensitive drums. Each developing cartridge has a developing roller for supplying toner to the corresponding photosensitive drum.

Such a tandem type color printer includes a retaining member provided in the main casing for collectively retaining the four developing cartridges. The retaining member is configured to be movable in a horizontal direction between the inside and the outside of the main casing. When any of the developing cartridges has run out of toner, the retaining member is pulled outward from the main casing, and the developing cartridge is removed from the retaining member, and a new developing cartridge is mounted in the retaining member.

Printer manufactures are recently urged to meet demand for cost reductions and environmental concerns. In terms of cost reductions and environmental concerns, it is desirable to employ a toner cartridge replacing system, in which only a toner cartridge for accommodating toner is replaced without replacing the developing roller, rather than to replace the developing cartridge with a new one, when toner has run out.

The toner cartridge is formed with an opening for discharging toner therefrom. Further, the toner cartridge is provided with a shutter for opening and closing the opening. When the toner cartridge has been removed from the retaining member, the shutter is moved to a closed position in confrontation with the opening, thereby closing the opening. This configuration prevents toner accommodated in the toner cartridge from leaking out through the opening. When the toner cartridge has been mounted in the retaining member, in order to supply toner accommodated in the toner cartridge to the developing roller, the shutter is moved to an open position not in confrontation with the opening, thereby opening the opening.

Hence, in the toner cartridge replacing system, the shutter is required to be closed when the toner cartridge is removed from the retaining member and to be open when the toner cartridge is mounted in the retaining member. Accordingly, an operation unit is required to operate the shutter to move between the open position and the closed position.

SUMMARY

However, when the retaining member has been pulled outward from the main casing, the center of gravity of the color printer has been moved to a pulled-out side of the retaining member. When a user operates the operation unit in this state, a moment relative to the color printer may be generated in a direction such that the retaining member moves downward, thereby causing turnover of the color printer.

In view of the foregoing, it is an object of the present invention to provide an image forming device and a toner cartridge, having structures capable of preventing the image forming device from overturning caused by operations of an operation unit.

In order to attain the above and other objects, the present invention provides an image forming device including: a main casing; a retaining member; a plurality of developing units; a plurality of toner cartridges; and an operation unit. The retaining member is configured to be movable in a first direction between an accommodated position inside the main casing and a pulled-out position pulled-out from the main casing. "Pulled-out from the main casing" implies that the retaining member is displaced from the accommodated position, such that the retaining member is separated from or still engaged with the main casing. The retaining member includes a first side plate and a second side plate extending in the first direction and disposed in confrontation with and spaced apart from each other in a second direction orthogonal to the first direction. The plurality of developing units is retained in the retaining member. The plurality of toner cartridges has one-on-one correspondence to the plurality of developing units and is configured to be mountable in or detachable from the retaining member when the retaining member is located at the pulled-out position. Each toner cartridge includes a casing formed with a cartridge opening for supplying toner accommodated in the casing to the corresponding developing unit, and a cartridge shutter configured to be movable between an open position for opening the cartridge opening and a closed position for closing the cartridge opening. The operation unit is provided in the retaining member and configured to be pivotally movable in an imaginary plane parallel to the first direction and the second direction. The operation unit is interlocked with the cartridge shutter while the toner cartridge is mounted in the retaining member to move the cartridge shutter between the open position and the closed position in accordance with the pivotal movement of the operation unit.

According to another aspect, the present invention provides a toner cartridge including: a casing; a cartridge shutter; and a lock portion. The casing extends in one direction and defines an internal space for accommodating toner. The casing has a wall formed with a cartridge opening section through which an interior and an exterior of the casing communicate. The cartridge shutter includes a shutter body formed in a plate shape and extending in the one direction, and a cartridge shutter shaft extending in a direction orthogonal to a plane including the cartridge opening section. The shutter body is configured to be pivotally movable about the cartridge shutter shaft between an open position for opening the cartridge opening section and a closed position for closing the cartridge opening section. The lock portion is configured to inhibit the cartridge shutter from moving to the open position.

BRIEF DESCRIPTION OF THE DRAWINGS

The particular features and advantages of the present invention as well as other objects will become apparent from the following description taken in connection with the accompanying drawings, in which.

DETAILED DESCRIPTION

Next, an image forming device according to one embodiment of the present invention will be described while referring to the accompanying drawing.

1. Structure of Color Printer

Figure 1:
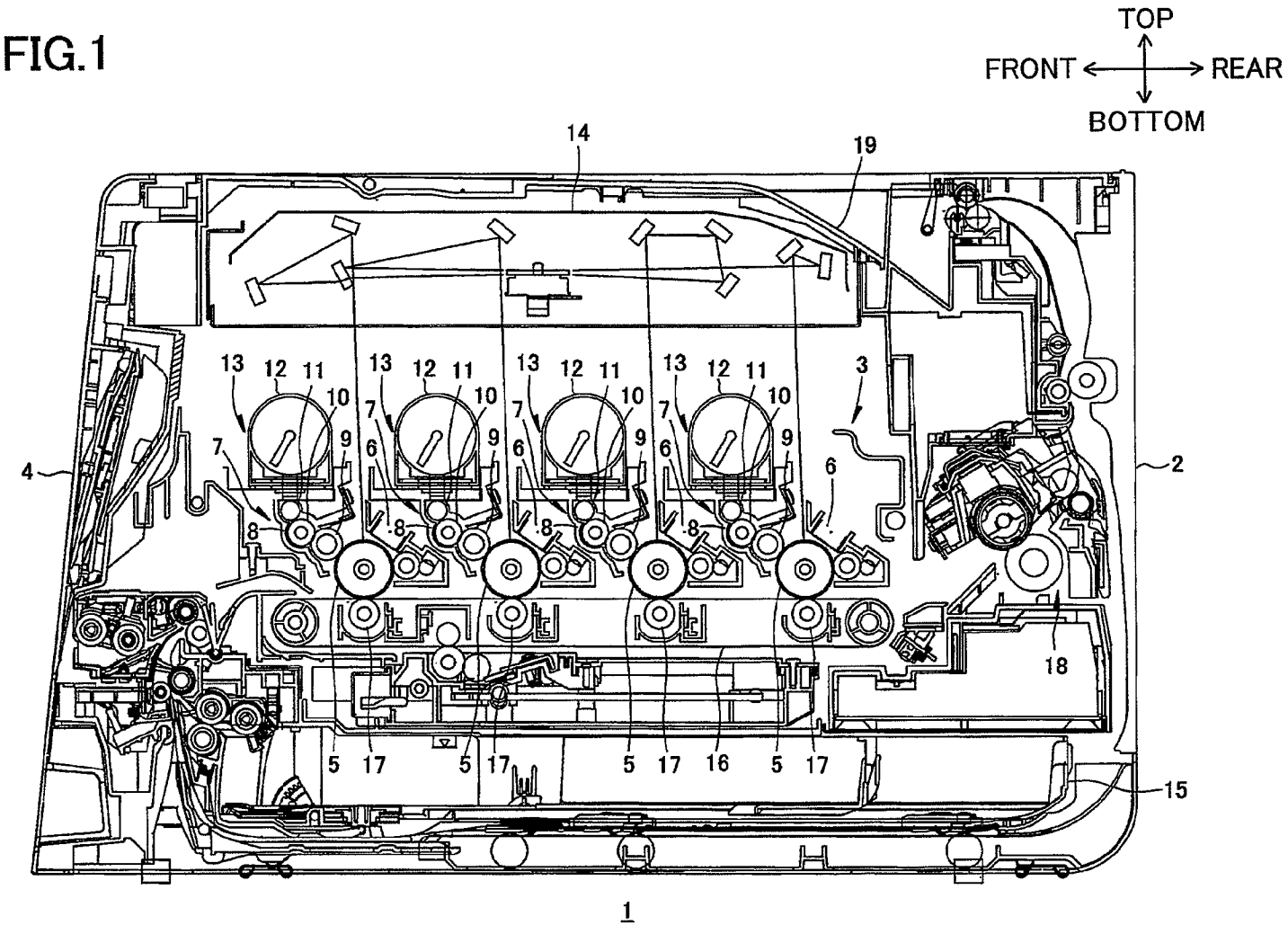
FIG. 1 is a cross-sectional view of a color printer according to one embodiment of the present invention.
Figure 2:
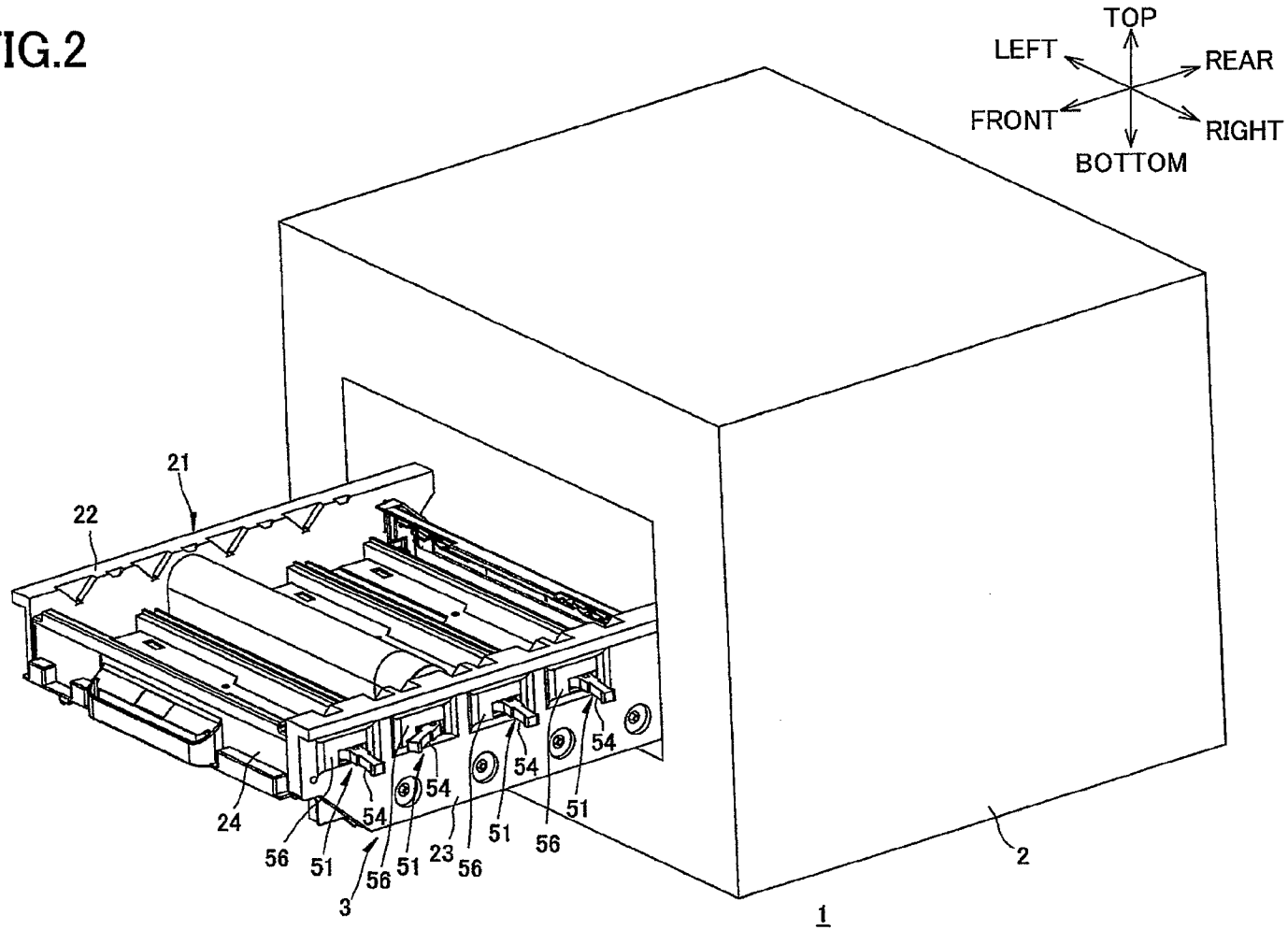
FIG. 2 is a perspective view of the color printer shown in FIG. 1 showing a drawer unit that has been pulled outward from a main frame of the color printer.

As shown in FIG. 1, the image forming device according to the embodiment is a tandem-type color printer 1. As shown in FIGS. 1 and 2, the color printer 1 includes a main casing 2. A drawer unit 3 is mounted inside the main casing 2. The main casing 2 has a front portion at which a front cover 4 is provided. The front cover 4 is movable between an open position and a closed position. When the front cover 4 is in the open position, the drawer unit 3 can be moved horizontally between an accommodated position inside the main casing 2 (a position shown in FIG. 1) and a pulled-out position outside the main casing 2 (a position shown in FIG. 2).

The terms "upward", "downward", "upper", "lower", "above", "below", "right", "left", "front", "rear" and the like will be used throughout the description assuming that the color printer 1 is disposed in an orientation in which it is intended to be used. In the following description, a side of the color printer 1 on which the front cover 4 is provided (left side in FIG. 1) will be referred to as a front side of the color printer 1. Top, bottom, left, and right sides of the color printer 1 in the following description will be based on the reference point of a user viewing the color printer 1 from the front side. Directions related to the drawer unit 3 and a toner cartridge 12, described later, that is mounted in the drawer unit 3 will be referenced based on their positions when mounted in the main casing 2, unless otherwise specified. Note that the front cover 4 has been omitted from FIG. 2.

The drawer unit 3 includes a drawer frame 21 installing four photosensitive drums 5, four chargers 6, and four developing units 7.

As shown in FIG. 1, the four photosensitive drums 5 are rotatably retained in the drawer unit 3. The photosensitive drums 5 are capable of rotating about axes extending in a left-to-right direction. The four photosensitive drums 5 are respectively provided for the colors black, yellow, magenta, and cyan. The photosensitive drums 5 are arranged parallel to each other at regular intervals in a front-to-rear direction in the order black, yellow, magenta, and cyan.

The four chargers 6 are also retained in the drawer unit 3. The chargers 6 have a one-on-one correspondence to the four photosensitive drums 5 and are disposed diagonally upward and rearward of the corresponding photosensitive drums 5. Each charger 6 is a Scorotron charger that includes a discharge wire and a grid, for example.

The four developing units 7 are also retained in the drawer unit 3.

The four developing units 7 also have a one-on-one correspondence to the four photosensitive drums 5, and are disposed diagonally above and forward of the corresponding photosensitive drums 5. Each developing unit 7 includes a developing unit frame 8. The developing unit frame 8 retains a developing roller 9, a supply roller 10, and an auger 11.

The developing roller 9 is disposed in contact with the photosensitive drum 5 and is capable of rotating about its axis extending in the left-to-right direction. The supply roller 10 is disposed diagonally above and forward of the developing roller 9 and in contact with the developing roller 9. The supply roller 10 is capable of rotating about its axis extending in the left-to-right direction. The auger 11 is disposed above the supply roller 10 and is capable of rotating about its axis extending in the left-to-right direction.

A space 13 is defined in the drawer unit 3 above each developing unit 7. A toner cartridge 12 is mounted in the space 13 defined above each developing unit 7. Sufficient free space above the drawer unit 3 is acquired for mounting the toner cartridges 12 in the spaces 13 by pulling the drawer unit 3 outward to the pulled-out position. Toner is accommodated in the toner cartridge 12. When the toner cartridge 12 has been mounted in the space 13, the toner cartridge 12 supplies toner to the developing unit frame 8.

Toner supplied to the developing unit frame 8 from the toner cartridge 12 is conveyed and dispersed by the auger 11 in the left-to-right direction. In association with rotations of the developing roller 9 and the supply roller 10, the supply roller 10 supplies the toner to the developing roller 9, thereby forming a thin layer of toner on a surface of the developing roller 9.

An exposure unit 14 is provided in the main casing 2 above the drawer unit 3. The exposure unit 14 irradiates four laser beams corresponding to the four colors used by the color printer 1.

As each photosensitive drum 5 rotates, the corresponding charger 6 applies a uniform charge to a surface of the photosensitive drum 5. Subsequently, the exposure unit 14 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of the photosensitive drum 5 rotates to a position opposite the corresponding developing roller 9, the developing roller 9 supplies toner to the electrostatic latent image, thereby forming a toner image on the surface of the photosensitive drum 5.

Four LED arrays may be provided for the four photosensitive drums 5 in place of the exposure unit 14.

A sheet cassette 15 accommodating sheets of paper P is disposed in a bottom section of the main casing 2. Each sheet P accommodated in the sheet cassette 15 is conveyed onto a conveying belt 16 by various rollers. The conveying belt 16 confronts the four photosensitive drums 5 from below. Four transfer rollers 17 are disposed inside the conveying belt 16 at positions confronting the photosensitive drums 5 through an upper portion of the conveying belt 16. When the sheet P is conveyed onto the conveying belt 16, the conveying belt 16 carries the sheet P sequentially through positions between the conveying belt 16 and each of the photosensitive drums 5. As the sheet P passes beneath each photosensitive drum 5, the toner image carried on the surface of the photosensitive drum 5 is transferred onto the sheet P.

A fixing unit 18 is provided at a position downstream of the conveying belt 16 with respect to a direction that the sheet P is conveyed. After toner images are transferred onto the sheet P, the sheet P is conveyed to the fixing unit 18, where the toner images are fixed to the sheet P by heat and pressure. After the toner images have been fixed in the fixing unit 18, various rollers discharge the sheet P onto a discharge tray 19 provided on a top surface of the main casing 2.

2. Drawer Unit (1) Drawer Frame

Figure 3:
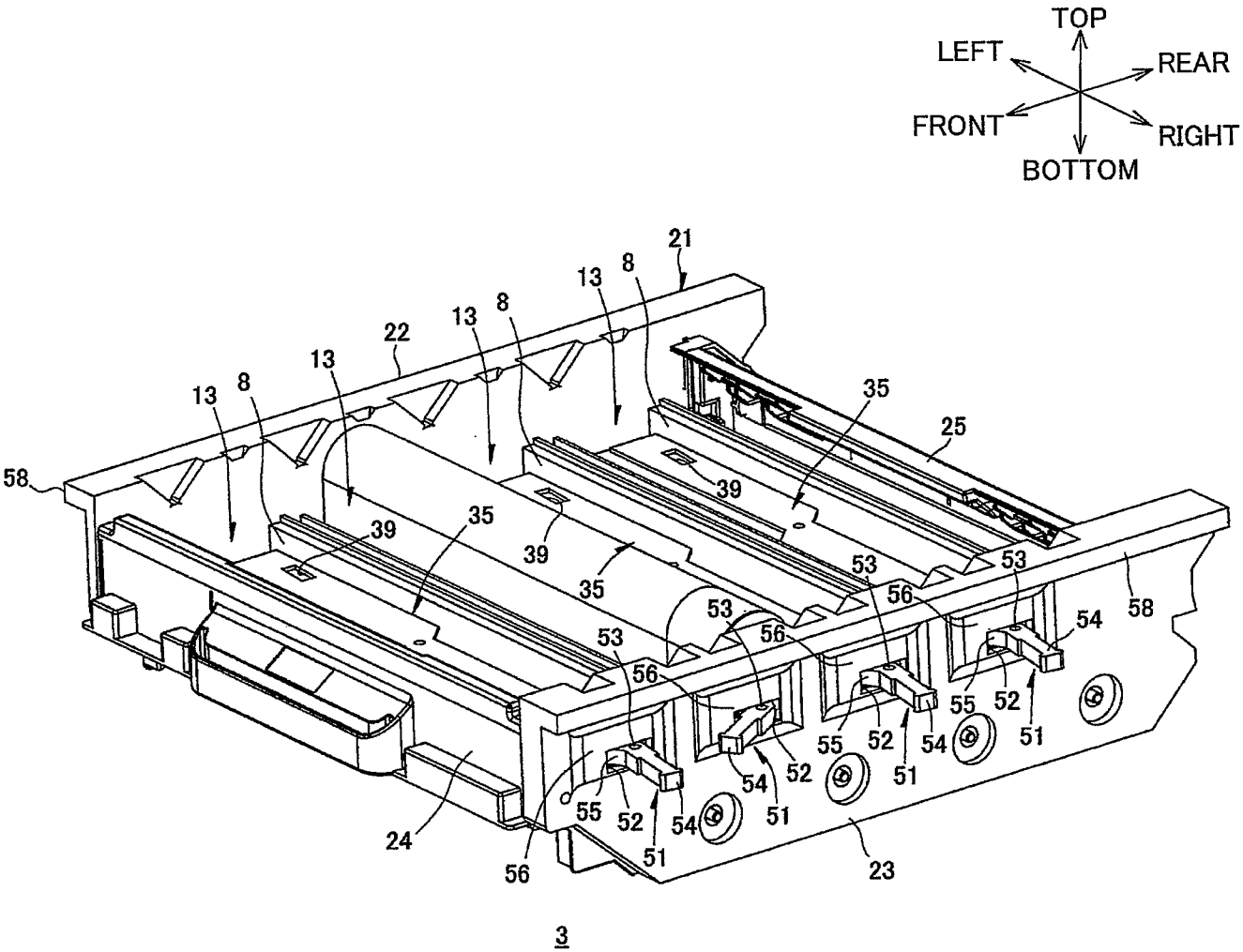
FIG. 3 is a perspective view of the drawer unit shown in FIG. 2 when a toner cartridge has been mounted in the drawer unit.
Figure 4:
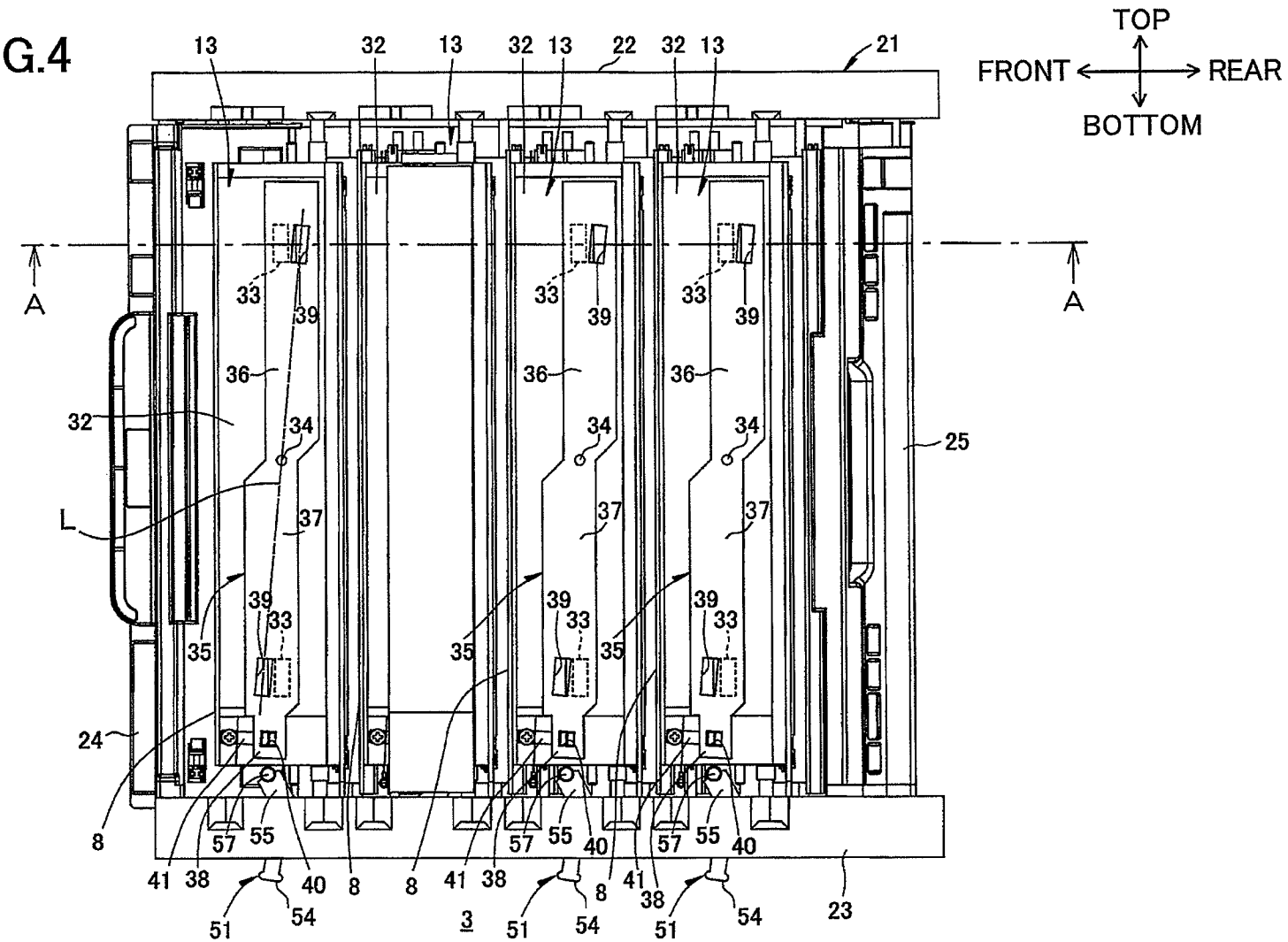
FIG. 4 is a plan view of the drawer unit shown in FIG. 3.

As shown in FIGS. 3 and 4, the drawer unit 3 has the drawer frame 21. The drawer frame 21 is configured of a pair of side plates 22 and 23 arranged parallel to each other and separated in the left-to-right direction, a front beam 24 bridging the front ends of the side plates 22 and 23, and a rear beam 25 bridging the rear ends of the side plates 22 and 23. The overall structure of the drawer frame 21 is square-shaped in a plan view.

The respective groups of four photosensitive drums 5, chargers 6, and developing units 7 (see FIG. 1) are all retained together between the side plates 22 and 23. The spaces 13 in which the toner cartridges 12 are mounted are defined between the side plates 22 and 23 above the corresponding developing units 7. In other words, the side plates 22 and 23 retain the photosensitive drums 5, the chargers 6, and the developing units 7. Further, the side plates 22 and 23 oppose each other in the left-to-right direction, with gaps formed therebetween to allocate the spaces 13 in which the toner cartridges 12 are mounted.

(2) Developing Unit Frame

Figure 5:
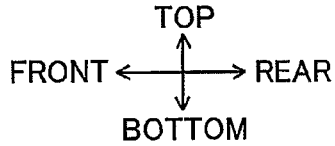
FIG. 5 is a cross-sectional view of the drawer unit taken along a line A-A shown in FIG. 4.
Figure 5:
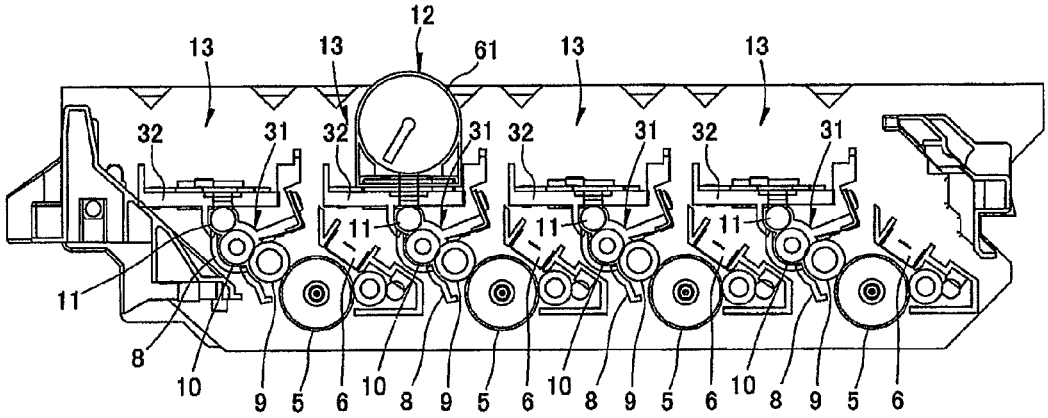

As shown in FIG. 5, the four developing unit frames 8 are disposed at regular intervals in the front-to-rear direction and span between the side plates 22 and 23. A developing chamber 31 is formed in each developing unit frame 8 for accommodating the developing roller 9, the supply roller 10, and the auger 11. A bottom side of the developing chamber 31 opposing the corresponding photosensitive drum 5 is open. The developing roller 9 is disposed in a bottom portion of the developing chamber 31, and a part of the developing roller 9 is at the opening.

The developing unit frame 8 has a plate-shaped partitioning wall 32 positioned between the developing chamber 31 and the space 13 in which the toner cartridge 12 is mounted. The partitioning wall 32 extends in the front-to-rear direction and in the left-to-right direction. The partitioning wall 32 partitions the interior of the developing unit frame 8 into the developing chamber 31 and the space 13 formed above the developing chamber 31. The toner cartridge 12 is mounted in the space 13 so as to be placed on the partitioning wall 32.

As shown in FIG. 4, each partitioning wall 32 is formed with two frame openings 33 disposed at positions slightly rearward from a center portion thereof in the front-to-rear direction and spaced apart from each other in the left-to-right direction. More specifically, the respective frame openings 33 are rectangular in shape and elongated in the left-to-right direction. The two frame openings 33 are arranged in alignment with each other in the left-to-right direction at positions slightly rearward from the center portion of the partitioning wall 32 in the front-to-rear direction. Further, one of the frame openings 33 (left frame opening 33) is disposed at a left end portion of the partitioning wall 32 and remaining one of the frame openings 33 (right frame opening 33) is disposed at a right end portion of the partitioning wall 32.

As shown in FIG. 4, each of the partitioning walls 32 has a frame shutter shaft 34 extending upward from an upper surface of the partitioning wall 32. The frame shutter shaft 34 is disposed in alignment with the two frame openings 33 in the left-to-right direction and intermediate between the frame openings 33. The frame shutter shaft 34 is equally spaced apart from each of the frame openings 33.

(3) Frame Shutter

The developing unit 7 includes a frame shutter 35. The frame shutter 35 is pivotably movably supported to the upper surface of the partitioning wall 32. That is, the frame shutter 35 is pivotable about the frame shutter shaft 34. The frame shutter 35 is formed in a plate shape extending in the left-to-right direction. The frame shutter 35 is integrally configured of a left portion 36, a right portion 37, and a lock unit 38. The left portion 36 extends leftward from the frame shutter shaft 34. The right portion 37 extends rightward from the frame shutter shaft 34. The lock unit 38 extends rightward from the right portion 37.

The left portion 36 and the right portion 37 are formed in a substantially rectangular shape in a plan view. The left portion 36 and the right portion 37 are connected to each other. More specifically, the left portion 36 has a right front corner, and the right portion 37 has a left rear corner connected to the right front corner of the left portion 36 at a position through which the frame shutter shaft 34 extends.

The frame shutter 35 is formed with two frame shutter openings 39. More specifically, one of the frame shutter openings 39 (left frame shutter opening 39) is formed in a left end portion of the left portion 36, and remaining one of the frame shutter openings 39 (right frame shutter opening 39) is formed in a right end portion of the right portion 37. Each of the frame shutter openings 39 has a rectangular shape substantially the same as the shape of the frame openings 33. The frame shutter openings 39 are arranged so as to be concyclic to an imaginary circle where a center is coincident with the frame shutter shaft 34. Further, the frame shutter openings 39 are positioned symmetrical with respect to the frame shutter shaft 34, that is, the frame shutter openings 39 are spaced apart from each other at an angle of 180 degrees about the frame shutter shaft 34.

In a state of the frame shutter 35 where the left portion 36 and the right portion 37 extend parallel to the left-to-right direction without being angled with respect to the left-to-right direction, the left frame shutter opening 39 is positioned rearward of the left frame opening 33 and the right frame shutter opening 39 is positioned frontward of the right frame opening 33. Each of the left and right frame shutter openings 39 is formed in a rectangular shape elongated and lies along an imaginary straight line L (FIG. 4) that passes through the frame shutter shaft 34. The imaginary straight line L inclines rearward toward a left end of the left portion 36.

In this state, lower surfaces of the left portion 36 and the right portion 37 confront the frame openings 33, thereby covering (closing) the frame openings 33. A position of the frame shutter 35 at this time will be referred to as "frame opening closed position". When the frame shutter 35 is pivotally moved about the frame shutter shaft 34 as fulcrum at an angle of 5 degrees so that the left portion 36 moves frontward, the frame shutter openings 39 confront the corresponding frame openings 33, thereby uncovering (opening) the frame openings 33. A position of the frame shutter 35 at this time will be referred to as "frame opening open position".

The lock unit 38 is rectangular-shaped in a plan view. The lock unit 38 has a center portion in which a square engagement hole 40 is formed. The partitioning wall 32 is provided with a frame shutter lock portion 41. The frame shutter lock portion 41 is provided at a position corresponding to the engagement hole 40. The frame shutter lock portion 41 is formed of a leaf spring plate. The frame shutter lock portion 41 extends in the front-to-rear direction. The frame shutter lock portion 41 has a front end portion that is fixed to the partitioning wall 32 and a rear end portion that is bent so as to protrude upward. When the frame openings 33 are closed by the frame shutter 35, the rear end portion of the frame shutter lock portion 41 is brought into engagement with the engagement hole 40 from below, thereby fixing the frame shutter 35 to the partitioning wall 32 at that position. That is, engagement of the frame shutter lock portion 41 with the engagement hole 40 inhibits the frame shutter 35 from pivotally moving about the frame shutter shaft 34 to maintain the frame opening closed position.

(4) Operation Unit

As shown in FIGS. 3 and 4, the right side plate 23 of the drawer frame 21 is provided with four operation units 51 in a one-on-one correspondence to the four spaces 13 in which the toner cartridges 12 is installed. More specifically, the side plate 23 is formed with four rectangular-shaped through holes 52 penetrating therethrough in the left-to-right direction. The through holes 52 are formed in the side plate 23 at positions corresponding to the spaces 13. The operation units 51 extend through the corresponding through holes 52.

Each of the operation units 51 includes a pivot shaft 53 extending in an up-to-down direction within the through hole 52, a first extending portion 54, and a second extending portion 55. These extending portions 54 and 55 are pivotally supported to the pivot shaft 53. With this configuration, the first extending portion 54 and the second extending portion 55 are pivotally horizontally movable about the pivot shaft 53. The pivot shaft 53 is disposed at a lower surface defining the through hole 52, and provided at a position closer to a left edge of the lower surface. The first extending portion 54 extends rightward from the pivot shaft 53. The second extending portion 55 extends leftward from the pivot shaft 53. The first extending portion 54 and the second extending portion 55 are integral with each other. The operation units 51 is formed of a substantially V-shape in a plan view, bending at a portion through which the pivot shaft 53 extends.

The first extending portion 54 is formed in a substantially quadrangular-prism shape. The second extending portion 55 is formed in a substantially quadrangular-prism shape having a length in the left-to-right direction smaller than that of the first extending portion 54. That is, the first extending portion 54 has a length in the left-to-right direction greater than that of the second extending portion 55. The second extending portion 55 has a distal end portion provided with a columnar interlocking boss 57. The interlocking boss 57 protrudes upward from an upper surface of the distal end portion of the second extending portion 55.

As shown in FIG. 3, by pivotally moving the operation unit 51 about the pivot shaft 53, the operation unit 51 can be shifted between a first posture and a second posture. In the first posture, a distal end portion of the first extending portion 54 is provided at a position relatively close to the side plate 23. In the second posture, the distal end portion of the first extending portion 54 is provided at a position relatively far from the side plate 23. That is, a distance between the distal end portion of the first extending portion 54 and the side plate 23 in the first posture is smaller than the distance in the second posture. In FIG. 3, the second operation unit 51 from the front is at the first posture, and remaining three operation units 51 are at the second posture. As shown in FIG. 4, when the operation unit 51 is at the second posture and each frame openings 33 is closed by the frame shutter 35, the distal end portion of the second extending portion 55 is located at a position in confrontation with the lock unit 38 of the frame shutter 35 in the left-to-right direction.

As shown in FIG. 3, the side plate 23 has a right side surface formed with four rectangular recessed portions 56. Each of the recessed portion 56 encompasses the through hole 52. When the operation unit 51 is at the first posture, the first extending portion 54 is located within the recessed portion 56. In other words, the right side surface of the side plate 23 is formed with the recessed portions 56 for defining spaces, in which an entirety of the first extending portions 54 at the first posture are accommodated.

Each of the through holes 52 is formed in a lower rear corner portion of the recessed portion 56 and penetrates through the side plate 23. When the operation unit 51 is at the first posture, the first extending portion 54 is located within the recessed portion 56, and thus, as shown in FIG. 4, the distal end portion of the first extending portion 54 is positioned leftward of a rightmost side surface of the side plate 23, that is, the distal end portion of the first extending portion 54 is positioned inward of an outmost side surface of the side plate 23. The side plate 23 has a top end portion formed with a flanged guide portion 58 protruding rightward. The guide portion 58 has a right side surface which serves as the rigthmost side surface of the side plate 23.

Incidentally, the guide portions 58 are respectively provided in the side plates 22 and 23 (FIG. 3). The guide portions 58 are engaged with respective guide grooves (not shown) formed in inner surfaces of the main casing 2. When the drawer unit 3 is moved in the front-to-rear direction, the guide portions 58 are guided by the guide grooves.

3. Toner Cartridge (1) Casing

Figure 6:
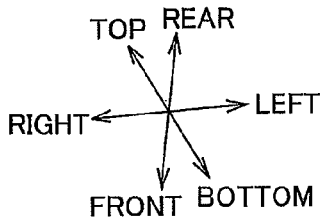
FIG. 6 is a perspective view of the toner cartridge shown in FIG. 1 as viewed from a lower rear side thereof.
Figure 6:
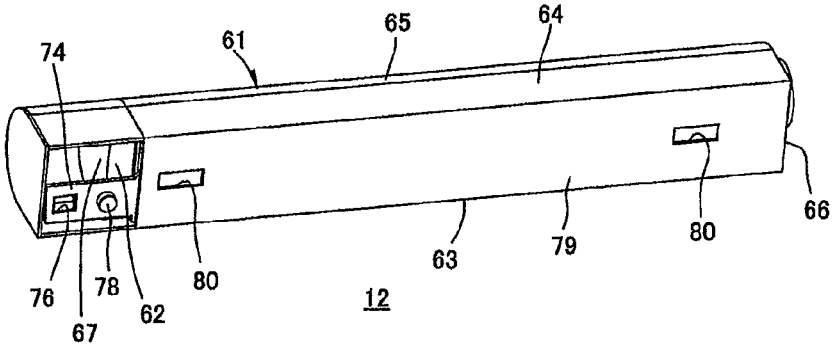

As shown in FIG. 6, the toner cartridge 12 includes a casing 61 having an internal space for accommodating toner. The casing 61 is formed of resin in a substantially hollow semicircular column shape and is elongated in the left-to-right direction. More specifically, the casing 61 includes a rectangular bottom wall 62, a front wall 63, a rear wall 64, a top wall 65, a left side wall 66, and a right side wall 67. The rectangular bottom wall 62 is elongated in the left-to-right direction. The front wall 63 is connected to a front edge of the bottom wall 62 and extends upward therefrom. The rear wall 64 is connected to a rear edge of the bottom wall 62 and extends upward therefrom. The top wall 65 bridges respective top edges of the front wall 63 and the rear wall 64, and has a substantially semicircular shape in a cross-section with a convex side facing upward. The left side wall 66 bridges respective left edges of the bottom wall 62, the front wall 63, the rear wall 64, and the top wall 65. The right side wall 67 bridges respective right edges of the bottom wall 62, the front wall 63, the rear wall 64, and the top wall 65.

Figure 7A:
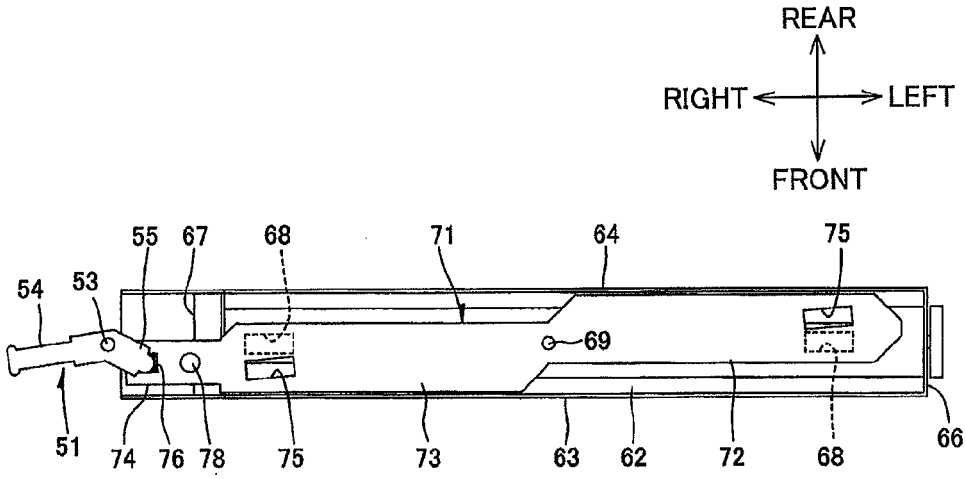
FIG. 7A is a bottom view of the toner cartridge shown in FIG. 6, in which a bottom cover has been removed from the toner cartridge and a cartridge shutter is in a closed position.

As shown in FIG. 7A, the bottom wall 62 is formed with two cartridge openings 68 disposed at a center portion thereof in the front-to-rear direction and spaced apart from each other in the left-to-right direction. More specifically, the cartridge openings 68 are rectangular in shape and elongated in the left-to-right direction. The cartridge openings 68 are arranged in alignment with each other in the left-to-right direction at the center portion of the bottom wall 62 in the front-to-rear direction. One of the cartridge openings 68 (left cartridge opening 68) is disposed at a left end portion of the bottom wall 62 and remaining one of the cartridge openings 68 (right cartridge opening 68) is disposed at a right end portion of the bottom wall 62. When the toner cartridge 12 has been mounted in the space 13 (FIG. 4), the cartridge openings 68 confront the corresponding frame openings 33.

The bottom wall 62 has a cartridge shutter shaft 69. The cartridge shutter shaft 69 is disposed in alignment with the cartridge openings 68 in the left-to-right direction and intermediate between the cartridge openings 68. The cartridge shutter shaft 69 is equally spaced apart from each of the cartridge openings 68. The cartridge shutter shaft 69 extends downward from the bottom wall 62.

(2) Cartridge Shutter

Figure 7B:
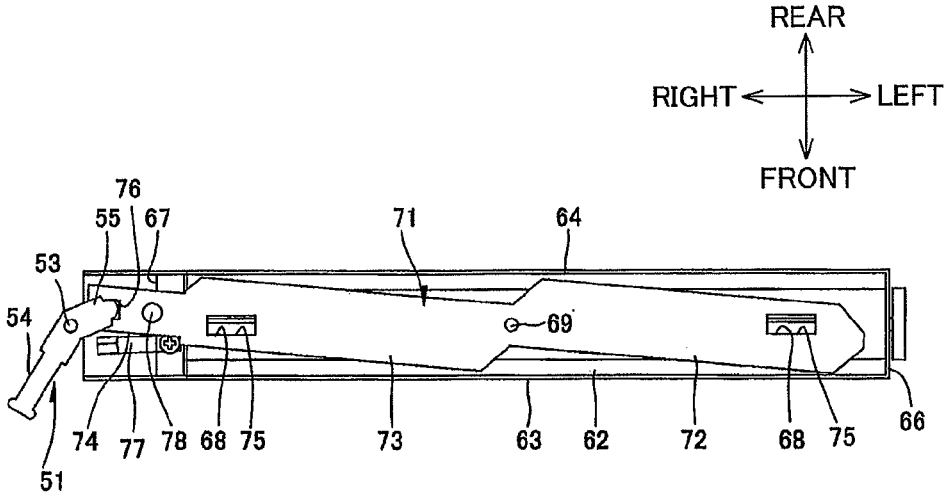
FIG. 7B is a bottom view of the toner cartridge shown in FIG. 6, in which the bottom cover has been removed from the toner cartridge and the cartridge shutter is in an open position.

The toner cartridge 12 further includes a cartridge shutter 71. As shown in FIGS. 7A and 7B, the cartridge shutter 71 is pivotally movably supported to the bottom wall 62. That is, the cartridge shutter 71 is pivotable about the cartridge shutter shaft 69.

The cartridge shutter 71 is formed in a plate shape extending in the left-to-right direction. The cartridge shutter 71 is integrally configured of a left portion 72, a right portion 73, and an interlocking portion 74. The left portion 72 extends leftward from the cartridge shutter shaft 69. The right portion 73 extends rightward from the cartridge shutter shaft 69. The interlocking portion 74 extends rightward from the right portion 73.

The left portion 72 and the right portion 73 are formed in a substantially rectangular shape in a plan view. The left portion 72 and the right portion 73 are arranged so as to be symmetrical with respect to the cartridge shutter shaft 69 and asymmetric with respect to an imaginary straight line extending in the front-to-rear direction passing through the cartridge shutter shaft 69.

More specifically, the left portion 72 and the right portion 73 are connected to each other. That is, the left portion 72 has a right front corner, and the right portion 73 has a left rear corner connected to the right front corner of the left portion 72 at a position through which the cartridge shutter shaft 69 extends.

The cartridge shutter 71 is formed with two cartridge shutter openings 75. More specifically, one of the cartridge shutter openings 75 (left cartridge shutter opening 75) is formed in a left end portion of the left portion 72, and remaining one of the cartridge shutter openings 75 (right cartridge shutter opening 75) is formed in a right end portion of the right portion 73. Each of the cartridge shutter openings 75 has a rectangular shape substantially the same as the shape of the cartridge openings 68. The cartridge shutter openings 75 are arranged so as to be concyclic to an imaginary circle where a center is coincident with the cartridge shutter shaft 69. Further, the cartridge shutter openings 75 are positioned symmetrical with respect to the cartridge shutter shaft 69, that is, the cartridge shutter openings 75 are spaced apart from each other at an angle of 180 degrees about the cartridge shutter shaft 69.

In a state of the cartridge shutter 71 where the left portion 72 and the right portion 73 extend parallel to the left-to-right direction without being angled with respect to the left-to-right direction, the left cartridge shutter opening 75 is positioned rearward of the left cartridge opening 68 and the right cartridge shutter opening 75 is positioned frontward of the right cartridge opening 68. Each of the left and right cartridge shutter openings 75 is formed in a rectangular shape elongated and lies along an imaginary straight line that passes through the cartridge shutter shaft 69. The imaginary straight line inclines rearward toward a left end of the left portion 72.

In this state, upper surfaces of the left portion 72 and the right portion 73 confront the cartridge openings 68, thereby covering (closing) the cartridge openings 68. A position of the cartridge shutter 71 at this time will be referred to as "closed position". When the cartridge shutter 71 is pivotally moved about the cartridge shutter shaft 69 as fulcrum at an angle of 5 degrees so that the left portion 72 moves frontward, the cartridge shutter openings 75 confront the corresponding cartridge openings 68, thereby uncovering (opening) the cartridge openings 68. A position of the cartridge shutter 71 at this time will be referred to as "open position".

Figure 8A:
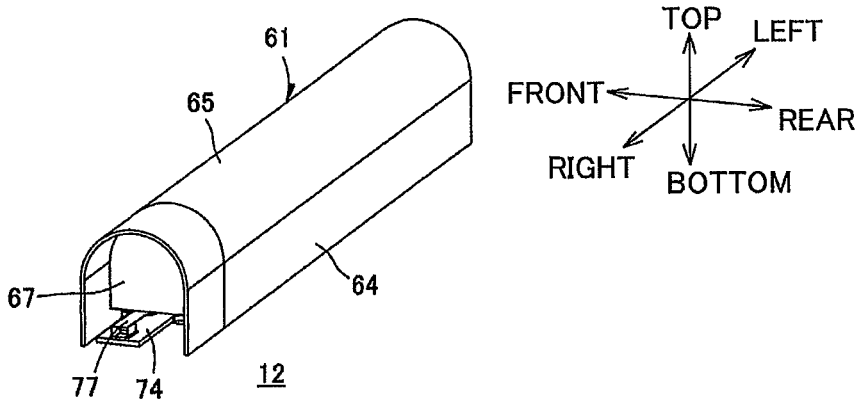
FIG. 8A is a perspective view of the toner cartridge shown in FIG. 6 as viewed from an upper right rear side thereof, showing a state prior to mounting of the toner cartridge in a drawer frame.
Figure 8B:
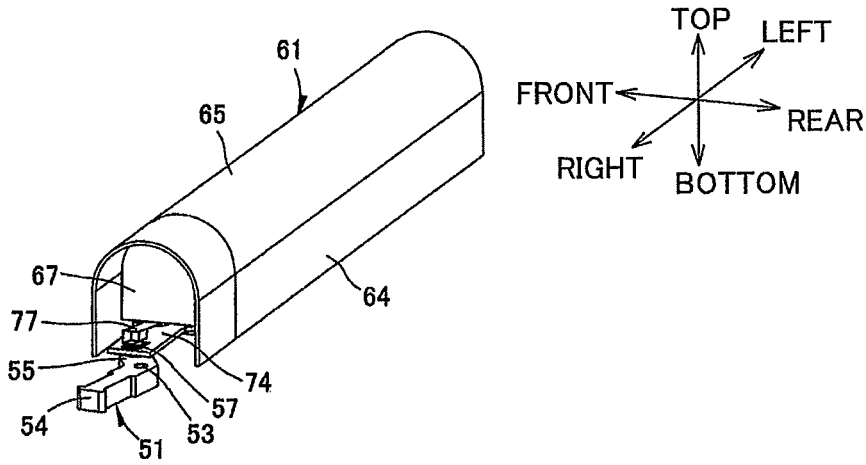
FIG. 8B is a perspective view of the toner cartridge shown in FIG. 6, accompanied by an operation unit, as viewed from the upper right rear side thereof, showing a state immediately after the toner cartridge has mounted in the drawer frame.

The interlocking portion 74 is rectangular-shaped in a plan view. The interlocking portion 74 has an end portion (right end portion) formed with an interlocking hole 76. As shown in FIGS. 8A and 8B, the bottom wall 62 of the casing 61 is provided with a cartridge shutter lock portion 77 formed of a leaf spring plate. The cartridge shutter lock portion 77 is provided at a position corresponding to the interlocking hole 76. The cartridge shutter lock portion 77 extends in the left-to-right direction. The cartridge shutter lock portion 77 has a left end portion that is fixed to a right end portion of the bottom wall 62 and a right end portion that is bent so as to protrude downward. When the cartridge openings 68 are closed by the cartridge shutter 71, the right end portion of the cartridge shutter lock portion 77 is brought into engagement with the interlocking hole 76 from above, thereby fixing the cartridge shutter 71 to the bottom wall 62 at that position. That is, engagement of the cartridge shutter lock portion 77 with the interlocking hole 76 inhibits the cartridge shutter 71 from pivotally moving about the cartridge shutter shaft 69 to maintain the closed position.

Further, the interlocking portion 74 includes a columnar shutter interlocking boss 78 protruding downward. The shutter interlocking boss 78 is positioned leftward of the interlocking hole 76, and provided at a position corresponding to the engagement hole 40 of the frame shutter 35 when the toner cartridge 12 has been mounted in the space 13.

(3) Bottom Cover

The toner cartridge 12 further includes a bottom cover 79. The bottom cover 79 confronts the bottom wall 62 interposing the cartridge shutter 71 between the bottom wall 62 and the bottom cover 79. The bottom cover 79 is formed in a plate shape in a bottom view substantially the same as the shape of the bottom wall 62. The bottom cover 79 is formed with two cover openings 80 at positions corresponding to the cartridge openings 68.

4. Mounting of Toner Cartridge

When the toner cartridge 12 is not mounted in the space 13, as shown in FIG. 4, the frame openings 33 are closed by the frame shutter 35 and the rear end portion of the frame shutter lock portion 41 is in engagement with the engagement hole 40 from below. The operation unit 51 is at the second posture, and the distal end portion of the second extending portion 55 is in confrontation with the lock unit 38 of the frame shutter 35 in the left-to-right direction.

On the other hand, while the toner cartridge 12 is detached from the drawer unit 3, the cartridge openings 68 are closed by the cartridge shutter 71. Further, as shown in FIG. 8A, the right end portion of the cartridge shutter lock portion 77 is in engagement with the interlocking hole 76 from above, and the cartridge shutter 71 is fixed to the bottom wall 62 at the closed position in which the cartridge shutter 71 covers the cartridge openings 68. Hence, while the toner cartridge 12 is detached from the drawer unit 3, the cartridge shutter 71 is not likely to inadvertently move to the open position from the closed position.

Figure 9A:
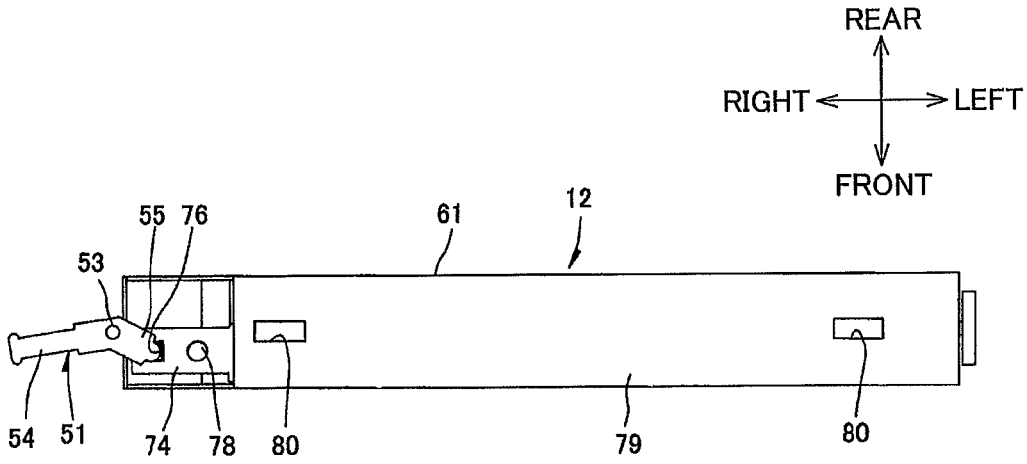
FIG. 9A is a bottom view of the toner cartridge shown in FIG. 6 when the cartridge shutter is in the closed position.
Figure 10A:
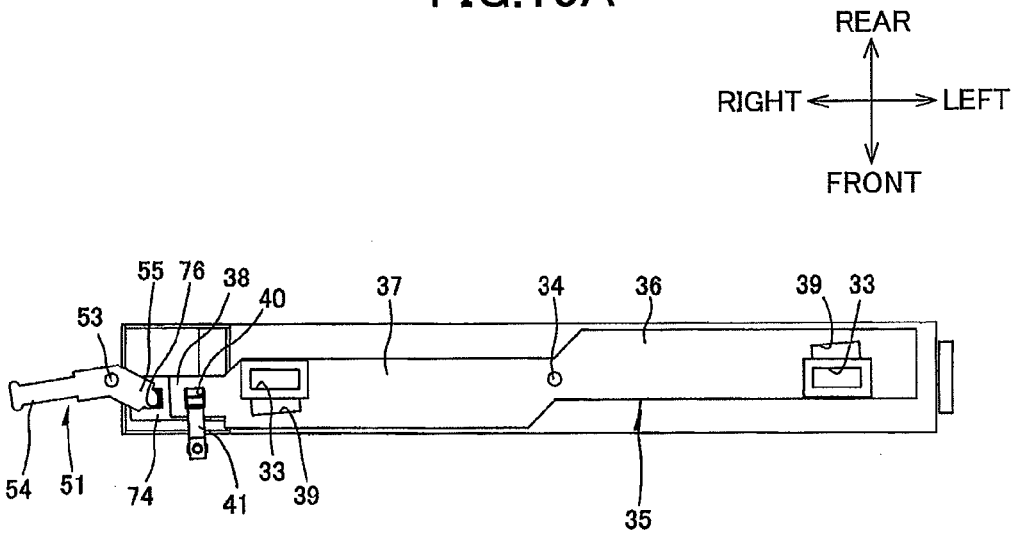
FIG. 10A is a bottom view of the toner cartridge shown in FIG. 6, accompanied by a frame shutter and a frame shutter lock portion, when the cartridge shutter is in the closed position.

While the drawer unit 3 (drawer frame 21) is pulled outward from the main casing 2 and disposed at the pulled-out position (FIG. 2), the toner cartridge 12 is detached from or mounted in the space 13 from above. When the toner cartridge 12 is mounted in the space 13, as shown in FIGS. 8B, 9A, and 10A, the interlocking boss 57 of the operation unit 51 is inserted into the interlocking hole 76 from below. As a result, the right end portion of the cartridge shutter lock portion 77 that has been engaged with the interlocking hole 76 is pushed by the interlocking boss 57 and disengaged from the interlocking hole 76. Hence, free movement of the cartridge shutter 71 can be achieved.

Further, when the toner cartridge 12 is mounted in the space 13, the shutter interlocking boss 78 of the cartridge shutter 71 is inserted into the engagement hole 40 of the frame shutter 35. As a result, the rear end portion of the frame shutter lock portion 41 that has been engaged with the engagement hole 40 is disengaged from the engagement hole 40. Hence, free movement of the frame shutter 35 can be achieved. Further, since the shutter interlocking boss 78 is inserted into the engagement hole 40, the frame shutter 35 and the cartridge shutter 71 are interlocked with each other.

Figure 8C:
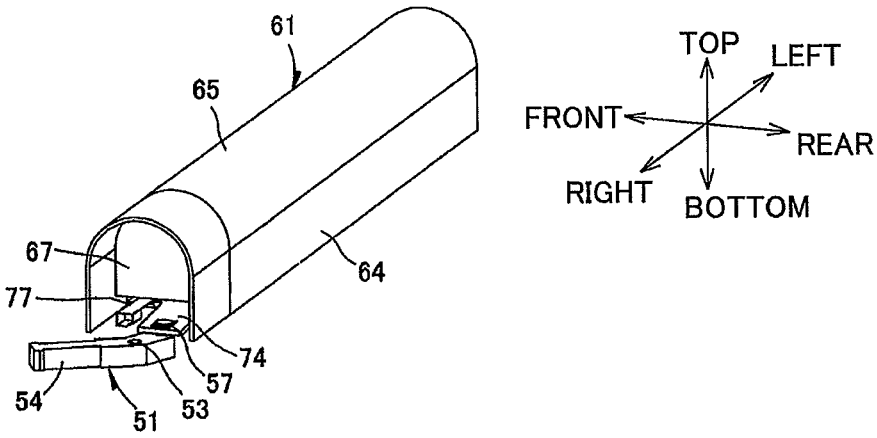
FIG. 8C is a perspective view of the toner cartridge shown in FIG. 6, accompanied by the operation unit, as viewed from the upper right rear side thereof when the cartridge shutter in the open position.
Figure 9B:
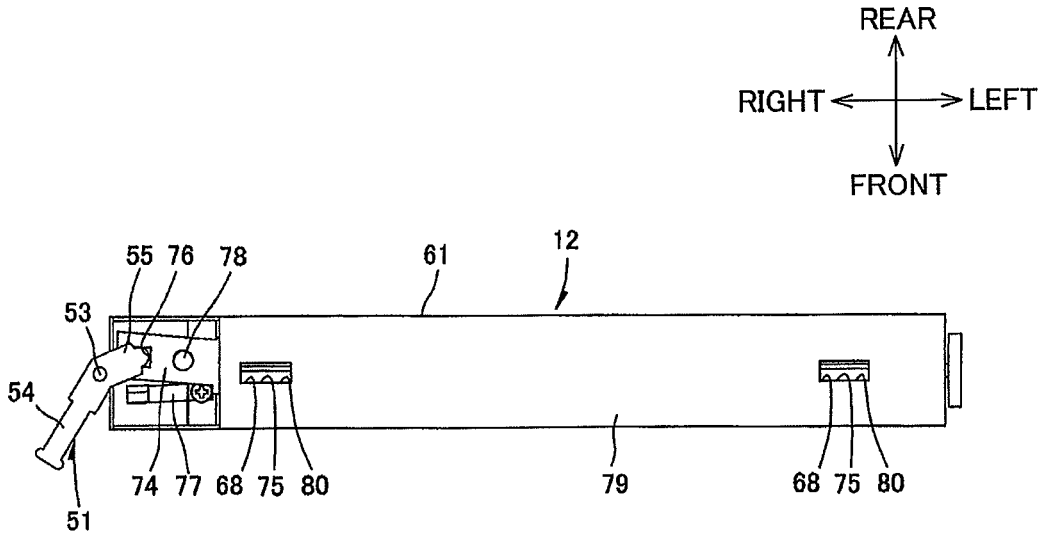
FIG. 9B is a bottom view of the toner cartridge shown in FIG. 6 when the cartridge shutter is in the open position.
Figure 10B:
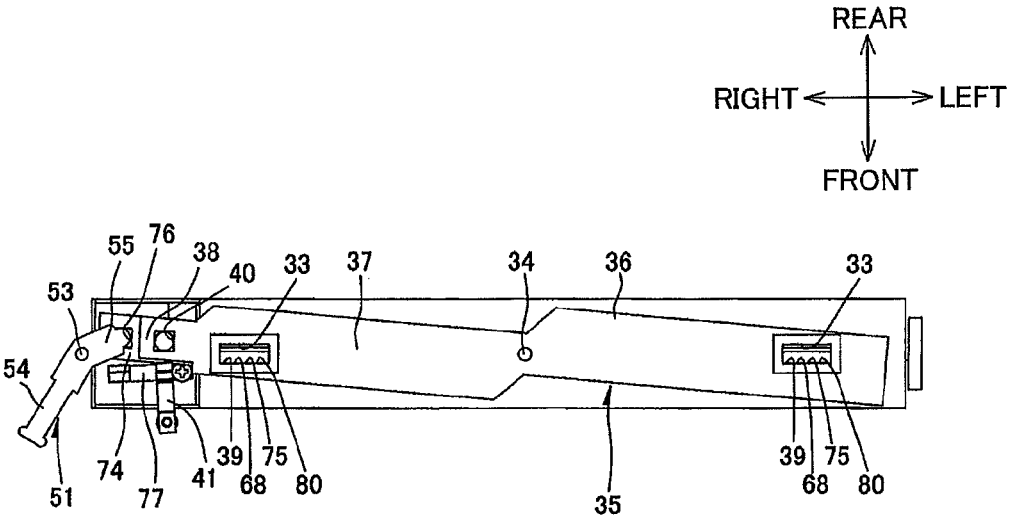
FIG. 10B is a bottom view of the toner cartridge shown in FIG. 6, accompanied by the frame shutter and the frame shutter lock portion, when the cartridge shutter is in the open position.

Then, the operation unit 51 is shifted from the second posture to the first posture. In association with the shift of the operation unit 51 to the first posture, as shown in FIGS. 8C, 9B, and 10B, the interlocking portion 74 of the cartridge shutter 71 is moved rearward, and the cartridge shutter 71 is pivotally moved about the cartridge shutter shaft 69 at an angle of 5 degrees in a clockwise direction as viewed from below. In association with pivot movement of the cartridge shutter 71, the frame shutter 35 is pivotally moved about the frame shutter shaft 34 at an angle of 5 degrees in the clockwise direction as viewed from below. As a result, the cartridge shutter openings 75 of the cartridge shutter 71 confront the cartridge openings 68 and the cover openings 80, and the frame shutter openings 39 of the frame shutter 35 confront the frame openings 33. Hence, fluid communication between the interior of the casing 61 of the toner cartridge 12 and the interior of the developing chamber 31 can be provided through the frame openings 33, the frame shutter openings 39, the cover openings 80, the cartridge shutter openings 75, and the cartridge openings 68. Thus, circulation of toner between the interior of the casing 61 and the interior of the developing chamber 31 can be achieved.

Then, when the drawer unit 3 (drawer frame 21) is moved to the accommodated position (FIG. 1) inside the main casing 2 from the pulled-out position, and the front cover 4 (FIG. 1) is closed, an image forming operation can be started in the color printer 1.

When the toner cartridge 12 is to be detached from the drawer unit 3, the drawer unit 3 is pulled out from the accommodated position to the pulled-out position. After the operation unit 51 is shifted to the second posture from the first posture, the toner cartridge 12 is lifted upward.

5. Operations and Effects (1) Operation and Effect 1

As described above, the drawer frame 21 is configured of the side plates 22 and 23 arranged in confrontation with and spaced apart from each other. The drawer frame 21 (drawer unit 3) is movable between the accommodated position in which the drawer frame 21 is accommodated in the main casing 2 and the pulled-out position in which the drawer frame 21 is pulled out of the main casing 2 in the front-to-rear direction that is a direction in which the side plates 22 and 23 extends. The drawer frame 21 retains the four developing units 7. Further, the drawer frame 21 retains the four toner cartridges 12. The four toner cartridges 12 are provided in a one-on-one correspondence to the four developing units 7. Each of the toner cartridges 12 is configured so as to be attachable to or detachable from the drawer frame 21 when the drawer frame 21 is at the pulled-out position.

The toner cartridge 12 has the casing 61 for accommodating toner therein. The casing 61 is formed with the two cartridge openings 68 for supplying toner to the developing unit 7. Further, the toner cartridge 12 has the cartridge shutter 71 movable between the open position for opening the cartridge openings 68 and the closed position for closing the cartridge openings 68.

The drawer frame 21 is provided with the operation unit 51 for operating the cartridge shutter 71 to move between the open position and the closed position. When the toner cartridge 12 is mounted in the drawer frame 21, the cartridge shutter 71 and the operation unit 51 are interlocked with each other. The operation unit 51 is configured so as to be pivotally movable in a horizontal plane parallel to the front-to-rear direction that is the moving direction of the drawer frame 21 and the left-to-right direction that is the confronting direction of the side plates 22 and 23. With this configuration, when the drawer frame 21 is at the pulled-out position, operation of the operation unit 51 for moving the cartridge shutter 71 to the open position or to the closed position does not generate a moment relative to the main casing 2 (image forming device) in a direction perpendicular to the horizontal plane but generates a moment relative to the main casing 2 in a direction parallel to the horizontal plane.

Accordingly, operation of the operation unit 51 does not generate a moment relative to the main casing 2 in a vertical direction, that is, a moment in a direction causing overturn of the color printer 1. As a result, overturn of the color printer 1 caused by operation of the operation unit 51 can be prevented.

(2) Operation and Effect 2

The cartridge shutter 71 is configured so as to be movable between the closed position and the open position along the horizontal plane. Hence, movement of the cartridge shutter 71 does not generate a moment relative to the main casing 2 in the vertical direction. As a result, overturn of the color printer 1 caused by operation of the operation unit 51 and by movement of the cartridge shutter 71 can be prevented.

(3) Operation and Effect 3

The cartridge shutter 71 is formed in a plate shape and extends in the left-to-right direction. Further, the cartridge shutter 71 is configured so as to be pivotally movable about the cartridge shutter shaft 69 extending in a direction perpendicular to the front-to-rear direction and left-to-right direction, that is, the up-to-down direction (vertical direction). Pivot movement of the cartridge shutter 71 about the cartridge shutter shaft 69 allows the cartridge shutter 71 to move between the open position and the closed position along the horizontal plane.

(4) Operation and Effect 4

The cartridge shutter shaft 69 is disposed at the center portion of the cartridge shutter 71 in the left-to-right direction. With this configuration, an amount of pivot movement of the cartridge shutter 71 between the closed position and the open position can be reduced, compared to a configuration in which the cartridge shutter shaft 69 is displaced leftward or rightward from the center portion of the cartridge shutter 71. Accordingly, the toner cartridge 12 and, eventually, the color printer 1 can be downsized.

(5) Operation and Effect 5

The operation unit 51 is pivotally movable in a plane identical to the horizontal plane along which the cartridge shutter 71 is movable. Hence, when the cartridge shutter 71 is pivotally moved in association with pivot movement of the operation unit 51, distortion in the operation unit 51 and the cartridge shutter 71 does not occur. Therefore, smooth movement of the cartridge shutter 71 can be ensured.

(6) Operation and Effect 6

The cartridge shutter 71 is formed with the interlocking hole 76, whereas the operation unit 51 is provided with the interlocking boss 57. When the toner cartridge 12 is mounted in the drawer frame 21, the interlocking hole 76 of the cartridge shutter 71 is brought into engagement with the interlocking boss 57 of the operation unit 51. Therefore, interlock of the cartridge shutter 71 with the operation unit 51 can be easily achieved.

(7) Operation and Effect 7

A distance between the cartridge shutter shaft 69 and the interlocking hole 76 is greater than a distance between the pivot shaft 53 and the interlocking boss 57. Hence, an amount of pivot movement (an angle of pivot movement) of the cartridge shutter 71 about the cartridge shutter shaft 69 can be minimized even if the operation unit 51 provides a considerably large pivot angle to move the cartridge shutter 71 between the closed position and the open position. Accordingly, enlargement of the toner cartridge 12 required by securing a space for pivotally moving the cartridge shutter 71 can be avoided.

(8) Operation and Effect 8

The operation unit 51 has the first extending portion 54 extending from the pivot shaft 53 in one direction and the second extending portion 55 extending from the pivot shaft 53 in another direction different from the direction in which the first extending portion 54 extends. The interlocking boss 57 is formed at the distal end portion of the second extending portion 55. By operating the first extending portion 54 to pivotally move the operation unit 51, the interlocking boss 57 is moved to pivotally move the cartridge shutter 71 formed with the interlocking hole 76 that engages with the interlocking boss 57.

A distance between the pivot shaft 53 and the distal end portion of the first extending portion 54 is greater than a distance between the pivot shaft 53 and the interlocking boss 57. Hence, because of the principle of leverage, magnitude of a force to be applied to the first extending portion 54 in order to pivotally move the cartridge shutter 71 can be reduced.

(9) Operation and Effect 9

The operation unit 51 is supported to the side plate 23. The pivot shaft 53 of the operation unit 51 is provided in the side plate 23 at a position closer to an inner (left) surface thereof in the left-to-right direction and within a thickness of the side plate 23. With this configuration, a distance between the pivot shaft 53 and the outer surface (right side surface) of the side plate 23 in the left-to-right direction can be increased. By increasing the length of the first extending portion 54, operability of the first extending portion 54 can be improved. Besides, a protruding amount of the first extending portion 54 such that the first extending portion 54 protrudes outward from the side plate 23 in the left-to-right direction can be restrained from increasing.

(10) Operation and Effect 10

The operation unit 51 can be shifted, as a result of its pivot movement, between the first posture in which the distal end portion of the first extending portion 54 is provided at a position relatively close to the side plate 23 and the second posture in which the distal end portion of the first extending portion 54 is provided at a position relatively far from the side plate 23. This configuration prevents the first extending portion 54 in the first posture from impinging against the main casing 2 during movement of the drawer frame 21. Further, this configuration allows the first extending portion 54 in the second posture to operate easily.

(11) Operation and Effect 11

When the operation unit 51 is in the first posture, the distal end portion of the first extending portion 54 is positioned inward of the right side surface of the side plate 23. Accordingly, the first extending portion 54 does not impinge against the main casing 2 when the drawer frame 21 is moved between the pulled-out position and the accommodated position, thereby preventing the operation unit 51 from interfering with movement of the drawer frame 21.

(12) Operation and Effect 12

The outer surface of the side plate 23 is formed with the four recessed portions 56. Each of the recessed portions 56 defines a space around the corresponding first extending portion 54 of the operation unit 51 that is in the first posture. Hence, a user can easily hold the first extending portion 54 of the operation unit 51 even when the operation unit 51 is in the first posture. Accordingly, operability of the operation unit 51 can be further improved.

(13) Operation and Effect 13

When the operation unit 51 is in the first posture, the distal end portion of the first extending portion 54 is oriented frontward (toward the pulled-out position) relative to the pivot shaft 53 of the operation unit 51. Further, when the operation unit 51 is in the second posture, the first extending portion 54 inclines with respect to the front-to-rear direction such that the first extending portion 54 inclines rightward (outward) toward the distal end portion of the first extending portion 54. In accordance with the movement of the drawer frame 21 to the accommodated position from the pulled-out position while the operation unit 51 is in the second posture, the first extending portion 54 is brought into abutment with the main casing 2 and, in association with further movement of the drawer frame 21, the first extending portion 54 is directed forward by the main casing 2. Accordingly, the operation unit 51 is automatically shifted to the first posture from the second posture. Further, in response to the shift of the operation unit 51 to the first posture from the second posture, the cartridge shutter 71 is moved to the open position from the closed position. Hence, after the toner cartridge 12 has been mounted in the drawer frame 21, accommodation of the drawer frame 21 in the main casing 2 while the cartridge shutter 71 remains in the closed position can be reliably prevented.

Assuming that the first extending portion 54 of the operation unit 51 is pivotally moved rearward when the operation unit 51 is shifted to the first posture from the second posture, that is, assuming that the first extending portion 54 extends rearward when the operation unit 51 is in the first posture and that the first extending portion 54 inclines rightward toward the distal end portion of the first extending portion 54 when the operation unit 51 is in the second posture, the operation unit 51 may be damaged when the drawer frame 21 is moved from the pulled-out position to the accommodated position while the cartridge shutter 71 remains in the closed position. This is because the first extending portion 54 impinges against the main casing 2. With configuration of the color printer 1 according to the present embodiment, such damage to the operation unit 51 can be prevented.

(14) Operation and Effect 14

Each of the developing units 7 is provided with the developing unit frame 8 and the frame shutter 35. The developing unit frame 8 is formed with the frame openings 33 at positions corresponding to the cartridge openings 68 of the toner cartridge 12 mounted in the drawer frame 21. The frame shutter 35 is configured to be movable between the frame opening closed position for closing the frame openings 33 and the frame opening open position for opening the frame openings 33.

The cartridge shutter 71 is provided with the shutter interlocking boss 78, whereas the frame shutter 35 is formed with the engagement hole 40. When the toner cartridge 12 is mounted in the drawer frame 21, the shutter interlocking boss 78 of the cartridge shutter 71 is brought into engagement with the engagement hole 40 of the frame shutter 35. Hence, interlock of the cartridge shutter 71 with the frame shutter 35 can be easily attained.

Because the cartridge shutter 71 is interlocked with the frame shutter 35, the frame shutter 35 can be shifted, by operating the operation unit 51, between the frame opening closed position and the frame opening open position in response to the shift of the cartridge shutter 71. Accordingly, no additional operation member to the operation unit 51 is required to shift the position of the frame shutter 35. Accordingly, configuration of the color printer 1 can be simplified.

(15) Operation and Effect 15

The toner cartridge 12 is provided with the cartridge shutter lock portion 77. The cartridge shutter lock portion 77 deters movement of the cartridge shutter 71 from the closed position to the open position when the toner cartridge 12 is not mounted in the drawer frame 21. With this configuration, when the toner cartridge 12 is not mounted in the drawer frame 21, the cartridge shutter 71 is maintained in the closed position. Accordingly, toner leakage from the toner cartridge 12 can be prevented.

(16) Operation and Effect 16

Each of the side plates 22 and 23 has the guide portions 58 guided by the guide grooves (not shown) formed in the main casing 2 when the drawer frame 21 is moved to/from the accommodated position from/to the pulled-out position. The guide portions 58 protrude outward from the outer side surfaces of the side plates 22 and 23, respectively, in the left-to-right direction. Further, the operation units 51 are disposed below the guide portion 58. The operation unit 51 can be shifted between the first posture in which the operation unit 51 disappears under the guide portion 58 and the second posture in which the operation unit 51 protrudes outward from the guide portion 58 in the left-to-right direction. Because the drawer frame 21 is moved between the accommodated position and the pulled-out position while the operation units 51 disappear under the guide portion 58, interference between the operation unit 51 and the main casing 2 with movement of the drawer frame 21 caused by the operation unit 51 can be prevented.

Further, if the operation unit 51 were directly provided in the cartridge shutter 71 of the toner cartridge 12, the guide portion 58 hinders the toner cartridge 12 from mounting in the drawer frame 21, because the guide portion 58 becomes an obstacle to the operation units 51. Thus, it is difficult or not possible to mount the toner cartridge 12 in the drawer frame 21. Since the operation units 51 are provided in the drawer frame 21 and positioned below the guide portion 58, this configuration prevents interference of the operation unit 51 with the toner cartridge 12 when the toner cartridge 12 is mounted in the drawer frame 21. Accordingly, smooth mounting of the toner cartridge 12 in the drawer frame 21 can be realized.

(17) Operation and Effect 17

The two cartridge openings 68 are formed in the bottom wall 62 and spaced apart from each other in the left-to-right direction. Further, the cartridge shutter shaft 69 is disposed between the cartridge openings 68. With this configuration, pivotal moving amount of the cartridge shutter 71 between the closed position and the open position can be reduced.

(18) Operation and Effect 18

The cartridge shutter 71 has a configuration symmetrical with respect to the cartridge shutter shaft 69 and asymmetric with respect to the imaginary straight line extending in the front-to-rear direction and passing through the cartridge shutter shaft 69. With this configuration, the positions of the cartridge openings 68 can be determined such that the left portion 72 of the cartridge shutter 71 relative to the cartridge shutter shaft 69 opens or closes the one of the cartridge openings 68 and the right portion 73 of the cartridge shutter 71 relative to the cartridge shutter shaft 69 opens or closes the remaining one of the cartridge openings 68. In association with slight pivot movement of the cartridge shutter 71 about the cartridge shutter shaft 69, the cartridge shutter 71 can open or close the cartridge openings 68.

While the invention has been described in detail with reference to the embodiment thereof, it would be apparent to those skilled in the art that various changes and modifications may be made therein without departing from the spirit of the invention.

What is claimed is:

1. An image forming device comprising:

a main casing;

a retaining member configured to be movable in a first direction between an accommodated position inside the main casing and a pulled-out position pulled-out from the main casing, the retaining member including a first side plate and a second side plate extending in the first direction and disposed in confrontation with and spaced apart from each other in a second direction orthogonal to the first direction;

a plurality of developing units retained in the retaining member;

a plurality of toner cartridges having one-on-one correspondence to the plurality of developing units and configured to be mountable in or detachable from the retaining member when the retaining member is located at the pulled-out position, each toner cartridge comprising a casing formed with a cartridge opening for supplying toner accommodated in the casing to the corresponding developing unit, and a cartridge shutter configured to be movable between an open position for opening the cartridge opening and a closed position for closing the cartridge opening; and an operation unit provided in the retaining member and configured to be pivotally movable in an imaginary plane parallel to the first direction and the second direction, the operation unit being interlocked with the cartridge shutter while the toner cartridge is mounted in the retaining member to move the cartridge shutter between the open position and the closed position in accordance with the pivotal movement of the operation unit.

2. The image forming device according to claim 1, wherein the cartridge shutter is configured to be movable between the open position and the closed position in the imaginary plane parallel to the first direction and the second direction.

3. The image forming device according to claim 2, wherein the cartridge shutter comprises a shutter body formed in a plate shape and extending in the second direction, and a cartridge shutter shaft extending in a third direction orthogonal to the first direction and the second direction, the shutter body being configured to be pivotally movable about the cartridge shutter shaft.

4. The image forming device according to claim 3, wherein the shutter body has a center portion in the second direction, the cartridge shutter shaft being disposed at the center portion.

5. The image forming device according to claim 2, wherein the cartridge shutter is movable in a plane parallel to the first direction and the second direction, the operation unit being pivotally movable in the imaginary plane identical to the plane.

6. The image forming device according to claim 2, wherein the cartridge shutter further comprises a first engaging portion; and wherein the operation unit comprises a first engaged portion engageable with the first engaging portion when the toner cartridge is mounted in the retaining member in a mounting direction, the first engaging portion being engaged with the first engaged portion from an upstream side in the mounting direction.

7. The image forming device according to claim 6, wherein the cartridge shutter shaft and the first engaging portion have a first distance therebetween, and wherein the operation unit has a pivot axis, the pivot axis and the first engaged portion having a second distance therebetween smaller than the first distance.

8. The image forming device according to claim 6, wherein the operation unit is supported to the first side plate and comprises:

a first extending portion extending from the pivot axis in a fourth direction and having a first distal end portion; and a second extending portion extending from the pivot axis in a fifth direction different from the fourth direction and having a second distal end portion provided with the first engaged portion, the pivot axis and the first distal end portion having a third distance therebetween, and the pivot axis and the first engaged portion having a fourth distance therebetween smaller than the third distance.

9. The image forming device according to claim 8, wherein the first side plate has an inner side surface and an outer side surface in the second direction, the pivot axis being positioned in the first side plate at a position closer to the inner side surface than to the outer side surface.

10. The image forming device according to claim 8, wherein the operation unit is shiftable between a first posture and a second posture as a result of pivot movement thereof, a distance between the first distal end portion and the first side plate in the first posture being smaller than the distance in the second posture.

11. The image forming device according to claim 10, wherein the first side plate has an outmost side surface in the second direction, the first distal end portion of the first extending portion being positioned inward of the outmost side surface when the operation unit is in the first posture.

12. The image forming device according to claim 11, wherein the first side plate has an outer side surface in the second direction formed with a recessed portion for providing a space around the operating portion in the first posture.

13. The image forming device according to claim 10, wherein in the first posture the first extending portion extends in the first direction such that the first distal end portion of the first extending portion is positioned frontward of the pivot axis, and in the second posture the first extending portion inclines with respect to the first direction such that the first distal end portion is positioned outward in the second direction.

14. The image forming device according to claim 1, wherein each of the developing units comprises:

a developing unit frame formed with a frame opening at a position corresponding to the cartridge opening of the toner cartridge retained in the retaining member; and a frame shutter configured to be movable between a frame opening open position for opening the frame opening and a frame opening closed position for closing the frame opening, wherein the cartridge shutter comprises a second engaging portion; and wherein the frame shutter comprises a second engaged portion engageable with the second engaging portion when the toner cartridge is mounted in the retaining member in a mounting direction, the second engaging portion being engaged with the second engaged portion from an upstream side in the mounting direction.

15. The image forming device according to claim 1 wherein the toner cartridge further comprises a lock portion that inhibits the cartridge shutter from moving to the open position when the toner cartridge is not mounted in the retaining member.

16. The image forming device according to claim 1, wherein the first side plate has an outer side surface in the second direction and the second side plate has an outer surface in the second direction, the retaining member further comprising guide portions respectively protruding outward from the outer surfaces of the first side plate and the second side plate, the guide portions being guided by the main casing when the retaining member is moved between the accommodated position and the pulled-out position, the operation unit being disposed below the guide portion.

17. A toner cartridge configured to be mountable in and detachable from an image forming device, the toner cartridge comprising:

a casing extending in one direction and defining an internal space for accommodating toner, the casing having a wall formed with a cartridge opening section through which an interior and an exterior of the casing communicate;

a cartridge shutter comprising a shutter body formed in a plate shape and extending in the one direction, and a cartridge shutter shaft extending in a direction orthogonal to a horizontal reference plane parallel to the wall formed with the cartridge opening section, the shutter body being configured to be pivotally movable about the cartridge shutter shaft between an open position for opening the cartridge opening section and a closed position for closing the cartridge opening section, and the shutter body being further configured to be movable parallel to the horizontal reference plane when the toner cartridge is mounted in the image forming device; and a lock portion configured to inhibit the cartridge shutter from moving to the open position.

18. The toner cartridge according to claim 17, wherein the shutter body has one end portion in the one direction provided with an interlocking portion; and wherein the lock portion is provided at one end portion of the wall in the one direction and is engageable with and disengageable from the interlocking portion.

19. The toner cartridge according to claim 17, wherein the cartridge opening section is formed with two cartridge openings spaced apart from each other in the one direction, the cartridge shutter shaft being disposed between the two cartridge openings.

20. The toner cartridge according to claim 17, wherein the shutter body has a configuration symmetrical with respect to the cartridge shutter shaft and asymmetric with respect to a plane passing through the cartridge shutter shaft and extending in a direction orthogonal to the one direction.

* * * * *